United States Patent [19]

Schreiner et al.

[11] B 4,014,660

[45] Mar. 29, 1977

[54] HOT-TINNED WIRE FOR ELECTROTECHNICAL PURPOSES AND METHOD FOR ITS PRODUCTION

[75] Inventors: Horst Schreiner, Nurnberg; Dieter Friedrich, Wendelstein, both of Germany

[73] Assignee: Siemens Aktiengesellschaft, Munich, Germany

[22] Filed: Oct. 31, 1974

[21] Appl. No.: 519,680

[44] Published under the second Trial Voluntary Protest Program on March 30, 1976 as document No. B 519,680.

[30] Foreign Application Priority Data

Nov. 12, 1973 Germany ..... 2356351

[52] U.S. Cl. ..... 29/183.5; 29/191.6; 29/199; 427/118; 427/357; 427/405; 427/433

[51] Int. Cl.[2] ..... B32B 15/00; C23C 1/04

[58] Field of Search ..... 117/114 B, 115, 128, 117/231; 29/183.5, 191.6, 195.5, 199; 427/118, 357, 405, 433

[56] References Cited

UNITED STATES PATENTS

| | | | |
|---|---|---|---|
| 3,573,008 | 3/1971 | Akin, Jr. | 29/199 |
| 3,579,377 | 5/1971 | Schreiner et al. | 117/114 B |
| 3,642,523 | 2/1972 | Schreiner et al. | 117/114 B |

*Primary Examiner*—L. Dewayne Rutledge
*Assistant Examiner*—Arthur J. Steiner
*Attorney, Agent, or Firm*—Kenyon & Kenyon Reilly Carr & Chapin

[57] ABSTRACT

Hot-tinned wire of copper or copper alloys is provided having a first coating of from 0.5 to 2 μm thick consisting of an SnBi alloy containing 2 to 10 percent by weight Bi or of a SnNi alloy containing 0.2 to 1 percent by weight Ni, and having a second coating 1 to 4 μm thick consisting of pure tin or of a SnPb alloy. The first coating acts as diffusion retarding film and retards the $Cu_3Sn$ phase growth considerably.

5 Claims, 2 Drawing Figures

HOT-TINNED WIRE FOR ELECTROTECHNICAL PURPOSES AND METHOD FOR ITS PRODUCTION

BACKGROUND OF THE INVENTION

The invention relates to a hot-tinned wire for electrotechnical purposes, made of copper or copper alloys with a dual-layer coating of tin or tin alloys.

The purpose of hot-tinning copper hook-up wires is to provide the wires with a firmly adhering coating of tin or tin alloys so as to assure a perfect and reliable solder connection when automatic soldering operations with soldering times of about 1 second are carried out. Freshly hot-tinned copper hook-up wires generally meet this requirement. However, their solderability decreases greatly after a long storage period, in consequence of which the soldering times increase up to more than 20 seconds. This deterioration of solderability is attributable to the formation of a $Cu_3Sn$ phase which is not, or only poorly, wettable by the solder. This phase forms at the boundary between copper and tin, its crystallites growing through thin tin coatings. Particularly in wires having eccentrically applied coatings, the $Cu_3Sn$ phase will very quickly penetrate to the surface in the area of the thinnest coating thickness.

For this reason, various attempts have previously been made to retard the penetration of the $Cu_3Sn$ phase to the surface of a hot-tinned wire. The first efforts were directed towards producing coatings as uniformly thick as possible, with a minimum coating thickness between 3 and 10 μum. For example, it is known from German Offenlegungsschrift No. 1,957,032 to profile the molten tin coating of a wire by means of a stripper nozzle, the aperture profile of which is bounded by a train of waves. The subsequent smoothing and uniform distribution of the tin then comes about automatically due to surface tension. Further, it is known from German Pat. No. 1,621,338 to improve the wettability of a wire by applying a thin first coating of tin or tin alloys and then subsequently applying a uniform thicker second coating. However, thick hot-tinning with concentric and uniformly applied coatings does not retard the formation and the penetration of the $Cu_3Sn$ phase. It is only the break-through of the $Cu_3Sn$ phase to the surface which is being retarded due to the greater expenditure of tin, i.e. greater distances at the same diffusion speed. Moreover, the realization of good concentricity of the coatings in hot-tinning operations employing wire speeds about 1.5 m/s will only be imperfect.

Therefore, it is an object of the invention to provide a hot-tinned wire of copper or copper alloy in which the formation and penetration of a $Cu_3Sn$ phase is effectively retarded and in which good solderability according to the solder ball test (DIN 40046 Sheet 18) with enveloping times of less than 2 seconds after a heat and time stress between 4 and 96 hours at 155°C in air is assured.

SUMMARY OF THE INVENTION

According to the invention, this problem is solved by a coated hot-tinned wire having a first inner coating of a thickness between 0.5 and 2 μm consisting of a SnBi alloy containing between 2 and 10 weight-percent Bi, or of a SnNi alloy containing between 0.2 and 1 weight-percent Ni, and a second outer coating of a thickness between 1 and 4 μm consisting of pure tin or a SnPb alloy.

The thickness of the first coating is preferably 1 μm, and the thickness of the second coating is preferably 2 μm.

A SnBi alloy containing 5 percent by weight Bi or SnNi alloy containing 0.5 percent by weight Ni is particularly well suited for the first coating. If SnPb alloys are used for the second coating, alloys containing between 40 and 70 percent by weight Pb are suited particularly well.

According to another embodiment of the invention, the coated hot-tinned wire is produced by applying the first coating is a first tin alloy bath, calibrating the layer by a first stripper member and cooling the alloy coating in a first cooling section until it is completely solidified, and the second coating is then applied in a second tin or tin alloy bath, calibrated by a second stripper member and cooled in a second cooling section until it is completely solidified.

As previously discussed, a $Cu_3Sn$ phase forms at the boundary between the copper and tin of hot-tinned wires which penetrates to the surface of the tin coating and is either not wetted by a solder or only poorly wetted. Besides this $Cu_3Sn$ phase, a $Cu_6Sn_5$ phase also forms which only slightly worsens the solderability of the wire. The quantitive ratio of these two phases to each other and their propagation in the area of the coating depends on the respective status of the time-heat stress of the wire. The instant invention is based on the recognition that SnBi alloy coatings containing between 2 and 10 percent by weight Bi, or SnNi alloy coatings containing between 0.2 and 1 percent by weight Ni, when applied to copper or copper alloys, retard the growth of the $Cu_3Sn$ phase considerably. This effect is attributable to the fact that the diffusion coefficients in the systems SnBi/Cu and SnNi/Cu are substantially lower at temperatures up to about 200°C than the diffusion coefficient in the system Sn/Cu, for instance. If a wire receives a two-layer coating, the first layer of which consists of one of the alloys mentioned the diffusion and, therefore, the growth of the Cu3Sn phase is retarded by a factor up to about 5 as compared to pure tin coatings or coatings consisting of other tin alloys. The first coating thus has the effect of a diffusion retarding film, this effect setting in at film thickness as thin as between 0.5 and 2 μm already. For the achievement of good wire solderability film thicknesses between 1 and 4 μm are sufficient for the second coating so that the wire according to the invention has a relatively thin mean coating thickness as compared to the known thickly hot-tinned wires. This makes possible savings in tin consumptions as well as economical production. Another advantage of the wire according to the invention is that the requirements as to the concentricity of the coatings do not have to be stringent in order to achieve good solderability. This is also attributable to the diffusion retarding effect of the first coating, by which the formation and growth of a $Cu_3Sn$ phase is adequately retarded, also in thin areas of the coating caused by eccentricity.

The wires according to the invention are produced by the two bath tinning method, whereby the wire passes through a first tin alloy bath and then a second tin or tin alloy bath in any manner, e.g. either vertically, obliquely, or horizontally. The wire may travel in both baths either in the same or in opposite direction. For stripping and limiting the respectively applied coatings, known stripping elements such as round diamond nozzles are used. An additional qualitative improvement of the wire with respect to its solderability and its resistance to aging may be achieved by the use of wavy profile nozzles. After calibration, the coatings are each cooled in a cooling section until they are completely solidified. Cooling may be effected by air or by vapor spray or by fluid. When the wire passes through the first tin alloy bath, the emphasis is on perfect and complete wetting of the wire by the tin alloy. This wetting depends on the material, diameter and surface quality of the wire. For example, for a copper wire of 0.5 mm diameter it suffices if the wire remains in the first tin alloy bath between 20 and 200 ms, preferably 50 ms for flawless wetting. After being provided with a first coating, the wire is flawlessly and completely wetted in a very short time in the second tin or tin alloy bath. Therefore, it may remain in the second bath for a shorter period of time. For a copper wire of 0.5 mm diameter, it is sufficient if it stays in the second bath between 5 and 100 ms, preferably 20 ms. Due to the shorter dwelling time in the second bath there is also less dissolution of the first coating in the second bath. The wire speeds employed in the production of the wire according to the invention are between 1 and 15 m/s.

BRIEF DESCRIPTION OF THE DRAWINGS

The $Cu_3Sn$ phase growth is explained below in greater detail by way of the example of a known thickly hot-tinned wire and of an embodiment example of a wire according to the invention, and with reference to the drawing. The thickness of the coatings in relation to the wire diameter are greatly exaggerated as shown.

DETAILED DESCRIPTION OF THE DRAWINGS

Figure 1:
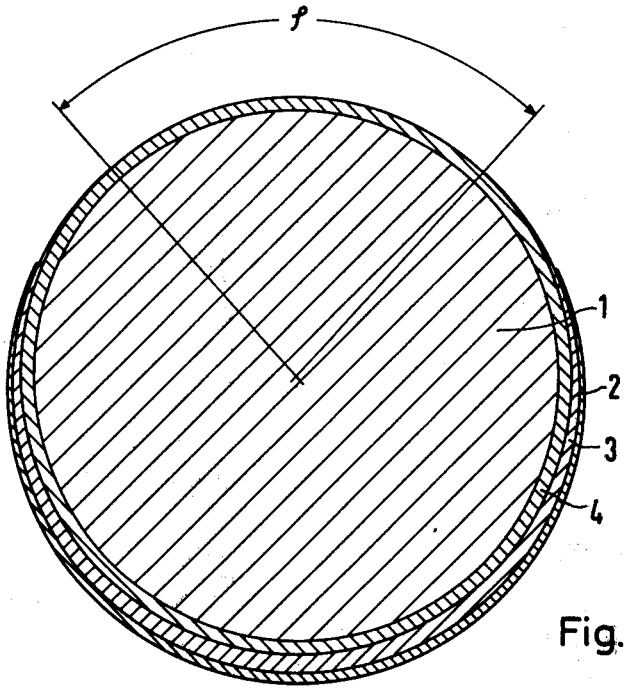
FIG. 1 shows, in cross section, a known thickly hot-tinned wire on which CuSn phases have formed and FIG. 2, in cross section, a wire according to the Invention, provided with a two-layer coating.

FIG. 1 shows a copper wire 1 which is provided with a pure tin coating 2. Since the self-excitation of transversal wire oscillations is a frequent occurrance in the production of thickly hot-tinned wires at higher wire speeds so that acceleration forces act upon the still molten tin, the coating 2 has formed eccentrically on the copper wire 1. A $Cu_6Sn_5$ phase 3 and a $Cu_3Sn$ phase 4, such as develop in a temperature/time aging process, have grown through parts of the coating 2. The propagation of these two phases in the coating 2 is readily recognizable in a ground section because the $Cu_6Sn_5$ phase 3 in colored light-gray to white and the $Cu_3Sn$ phase 1 is of a dark-gray color. The $Cu_3Sn$ phase 4 has already penetrated to the surface of coating 2 in the area of angle L so that, in this area, the wire will be wetted by a solder either not at all or only very poorly.

Figure 2:
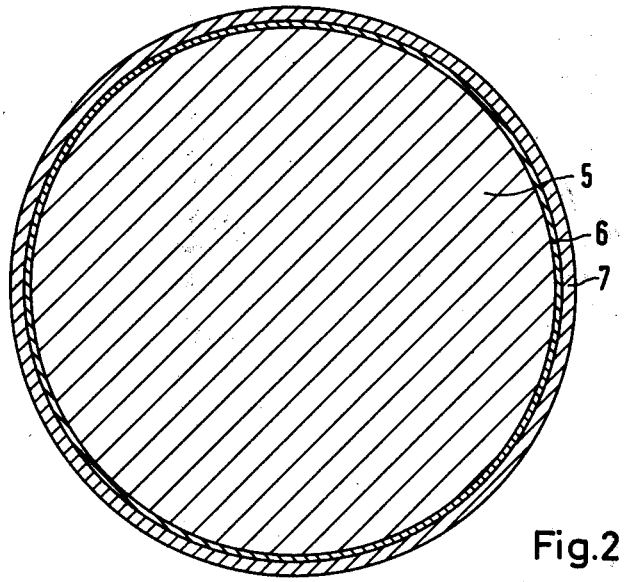

FIG. 2 shows a copper wire 5 which is provided with a first coating 6 consisting of a SnNi alloy and a second coating 7 consisting of a SnPb alloy. The first coating 6 has the effect of a diffusion retarding film so that, even after temperature/time aging, a CuSn growth can be detected either not at all or only to a slight extent.

The following Examples will explain the invention in greater detail:

EXAMPLE 1

A pure copper wire of 0.5 mm diameter was led through a first bath consisting of a SnBi alloy containing 5 percent by weight Bi, through a first round diamond nozzle and through a first air cooling section. The wire remained in the first bath for 50 ms. Subsequently, the wire, coated with a SnBi alloy, passed through a second bath consisting of a SnPb 40 alloy, through a second round diamond nozzle and through a second air cooling section. The wire remained in the second bath for 20 ms. The ground section of the wire provided with a two-layer coating showed a SnBi layer approximately 1 $\mu$m thick and a SnPb layer approximately 2 $\mu$m thick. After storage in air at 155°C for 4 days, this wire showed in the solder ball test an average soldering time of less than 1 second and, therefore, excellent soldering characteristics.

EXAMPLE 2

A pure copper wire of 0.5 mm diameter was led through a first bath consisting of a SnNi alloy containing 0.5 percent by weight Ni, through a round diamond nozzle and through a first air cooling section. The wire remained in the first bath for 50 ms. Subsequently, the wire, coated with a SnNi alloy, passed through a second bath consisting of pure tin, through a wavy profile nozzle and through a second air cooling section. The wire remained in the second bath for 20 ms. The ground section of the wire provided with a two-layer coating showed a SnNi film approximately 1 $\mu$m thick and a tin film approximately 2 $\mu$m thick, the concentricity of the layers being very good. After storage in air at 155°C for 4 days, this wire showed in the solder ball test an average soldering time of less than 1 second and, therefore, excellent soldering characteristics.

What is claimed is:

1. A hot-tinned wire of copper or copper alloys having a two-later coating of tin or tin alloys, wherein the first inner coating is of a thickness between 0.5 and 2 $\mu$m and consists of a SnBi alloy containing between 2 and 10 percent by weight of Bi or of a SnNi alloy containing between 0.2 and 1 percent by weight of Ni and a second outer coating of a thickness between 1 and 4 $\mu$m consisting of pure tin or a SnPb alloy.

2. The hot-tinned wire of claim 1, wherein the first inner coating is of a thickness of 1 $\mu$m and the second outer coating is of a thickness of 2 $\mu$m.

3. The hot-tinned wire of claim 1, wherein the first inner coating consists of a SnBi alloy containing 5 percent by weight Bi or of a SnNi alloy containing 0.5 percent by weight Ni.

4. The hot-tinned wire of claim 1, wherein the second outer coating consists of a SnPb alloy containing between 40 and 70 percent by weight Pb.

5. A method for producing the hot-tinned wire of claim 1 comprising;

a. passing a wire of copper or copper alloy through a first tin alloy bath, said alloy being a Bi-Sn alloy containing from 2 to 10 percent by weight of Bi or a Sn-Ni alloy containing from 0.2 to 1 percent by weight of Ni;

b. calibrating said wire by means of a first stripper member to provide an inner coating of a thickness between 0.5 and 2 $\mu$m on said wire;

c. cooling said wire to completely solidify said coating;

d. passing said coated wire through a second tin alloy bath, said alloy being a pure tin or Sn-Pb alloy;

e. calibrating said wire by means of a first stripper member to provide an outer coating of a thickness between 1 and 4 $\mu$m; and f. cooling said wire to completely solidify said outer coating.

* * * * *